US007673640B2

(12) United States Patent
Haslach, Jr. et al.

(10) Patent No.: US 7,673,640 B2
(45) Date of Patent: Mar. 9, 2010

(54) TILTABLE UNDERARM SUPPORT MECHANISM AND CRUTCH-LIKE MOBILITY ASSIST DEVICE USING SAME

(75) Inventors: Henry W. Haslach, Jr., Greenbelt, MD (US); James R. Borrelli, North Potomac, MD (US)

(73) Assignee: University of Maryland, College Park, MD (US)

( * ) Notice: Subject to any disclaimer, the term of this patent is extended or adjusted under 35 U.S.C. 154(b) by 468 days.

(21) Appl. No.: 11/637,929

(22) Filed: Dec. 13, 2006

(65) Prior Publication Data

US 2007/0144567 A1 Jun. 28, 2007

Related U.S. Application Data

(60) Provisional application No. 60/743,028, filed on Dec. 13, 2005.

(51) Int. Cl.
*A61H 3/02* (2006.01)

(52) U.S. Cl. ..... 135/73; 135/68

(58) Field of Classification Search ..... 135/65, 135/68, 71, 73, 76; 267/153
See application file for complete search history.

(56) References Cited

U.S. PATENT DOCUMENTS

| | | | | |
|---|---|---|---|---|
| 39,854 | A | 9/1863 | Wemple | |
| 254,348 | A | 2/1882 | Maine | |
| 467,675 | A | 1/1892 | McGrain | |
| 562,333 | A | 6/1896 | Lund | |
| 786,921 | A | 4/1905 | Smith | |
| 1,088,630 | A | 2/1914 | Sharp | |
| 1,137,008 | A | 4/1915 | Kindermann | |
| 1,183,008 | A | 5/1916 | Hipwood | |
| 1,266,074 | A | 5/1918 | Sparrow | |
| 1,283,387 | A | 10/1918 | Whalen et al. | |
| 1,292,503 | A | 1/1919 | Michel | |
| 1,318,505 | A | 10/1919 | Rabczynski | |
| 1,329,775 | A | 2/1920 | Kistler | |
| 1,334,208 | A | 3/1920 | Ames | |
| 1,342,506 | A | 6/1920 | Louison | |
| 1,407,553 | A | 2/1922 | Louison | |
| 1,495,865 | A | 5/1924 | Moore | |
| 1,635,914 | A | 7/1927 | Weis | |
| 2,364,053 | A | 12/1944 | Bourne | |
| 2,429,409 | A | 10/1947 | Eidman | |
| 2,442,896 | A | 6/1948 | Joseph | |
| 2,515,798 | A | 7/1950 | Redcliffe | |
| 2,547,265 | A | 4/1951 | Hilgeman | |
| 2,569,739 | A | 10/1951 | Thunberg | |
| 2,696,826 | A | 12/1954 | Davies | |
| 2,707,478 | A | 5/1955 | Davies | |
| 4,712,940 | A * | 12/1987 | Wood, Jr. | 403/133 |
| 5,113,887 | A | 5/1992 | Herman, Jr. | |

(Continued)

*Primary Examiner*—David Dunn
*Assistant Examiner*—Danielle Jackson
(74) *Attorney, Agent, or Firm*—Dykema Gossett PLLC

(57) ABSTRACT

A crutch-like mobility assist device includes a vertical support assembly, a footer assembly attached to a lower connection member of the vertical support assembly, and a tiltable underarm support mechanism connected to an upper connection member of the vertical support assembly, the tiltable underarm support mechanism including a base plate which is rotatable relative to the vertical support assembly, a saddle, and two damper devices between the base plate and the saddle which enable the saddle to tilt forwardly and rearwardly, as well as laterally relative to the vertical support assembly. The tiltable underarm support mechanism is itself usable on crutches of conventional construction.

17 Claims, 2 Drawing Sheets

U.S. PATENT DOCUMENTS 5,217,033 A 6/1993 Herman, Jr.
5,640,986 A * 6/1997 Herman ..... 135/68
5,862,824 A 1/1999 Herman
2002/0144723 A1 10/2002 Zulla et al.
2003/0106576 A1 6/2003 Tunnell, Jr. et al.

* cited by examiner

TILTABLE UNDERARM SUPPORT MECHANISM AND CRUTCH-LIKE MOBILITY ASSIST DEVICE USING SAME

CROSS-REFERENCE TO RELATED APPLICATION

This application is based on U.S. Provisional Application No. 60/743,028, filed Dec. 13, 2005, the contents of which are herein incorporated by reference and the priority of which is hereby claimed.

BACKGROUND OF INVENTION

1. Field of the Invention

The present invention relates to crutch-like mobility assist devices which can be used by injured and handicapped individuals and which provide a ground or floor-engaging base that remains parallel to and flat on the ground or flooring surface as the user moves forward. It also relates to tiltable underarm support mechanisms that can be employed with such mobility-assist devices, or with conventional crutches, to provide comfort to the user.

2. The Prior Art

Crutch-like mobility assist devices of the foregoing type are well known. See, for example, U.S. Pat. No. 5,640,986. Such devices include underarm support mechanisms which are designed to support more weight of the user than conventional crutches (with conventional crutches the user places great weight on the handles, whereas with crutch-like mobility assist devices a greater weight is placed on the shoulder support devices). In some cases the angular orientation of these underarm support mechanisms can be adjusted relative to the vertical support assembly to which they are attached. However, the underarm support mechanisms for conventional mobility assist devices do not enable tilting thereof laterally, as well as forwardly and rearwardly, and thereby cannot provide a maximum comfort to the user when the mobility assist device is extended away from the user's body to achieve the stability of a wide support base.

It is an object of the present invention to provide a crutch-like mobility assist device with an underarm support mechanism which provides for tiltability, not only forwardly and rearwardly, but also laterally, to thereby provide maximum comfort to the user. It is also an object to provide an underarm support mechanism for any type of crutch which can be tilted not only forwardly and rearwardly, but also laterally, and which can be rotated relative to the vertical support assembly to which it is attached and then fixed in position, so as to provide the ultimate in custom fit for the user.

SUMMARY OF THE INVENTION

According to this invention, a tiltable underarm support mechanism for a crutch-like mobility assist device includes at least two damper devices mounted with longitudinal spacing on an elongated base plate, the base plate being rotatably mounted at the upper end of the crutch-like mobility assist device. The damper devices include damper boxes having laterally-extending slots in their top surfaces and support pins extending upwardly through these slots to support an armpit-engaging saddle thereabove, the damper boxes including biasing means to bias the lower ends of the support pins upwardly and perpendicularly relative to the base plate. Tilting movement of the saddle forwardly and rearwardly during use of the mobility assist device is provided by downward movement of one or both of the support pins in the damper boxes, while lateral tilting movement of the saddle is provided by lateral movement of the support pins along the lateral slots. When the base plate is mounted on the upper end of a vertical support assembly of a crutch-like mobility assist device, the support pins enable rotation of the saddle out of a plane defined by the rods of the vertical support assembly.

A damper pad can be positioned between the base plate and the upper end of the vertical support assembly so as to cushion downward forces applied to the saddle by a user.

The biasing means in the damper boxes can be provided by lower and upper blocks of compression material, the upper compression block including a hole through which the support pin extends. The support pin can include a ball at its lower end that is squeezed in position between the two blocks of compression material.

The tiltable underarm support mechanism can also be used at the upper end of a conventional crutch having one leg to provide the ultimate in comfort to the user.

The invention will be better understood by reference to the attached drawings, taken in conjunction with the following discussion.

BRIEF DESCRIPTION OF THE DRAWINGS

In the drawings,

FIG. 8 is an exploded view of a portion of the damper assembly of the underarm support mechanism.

DETAILED DESCRIPTION OF THE PREFERRED EMBODIMENT

Figure 1:
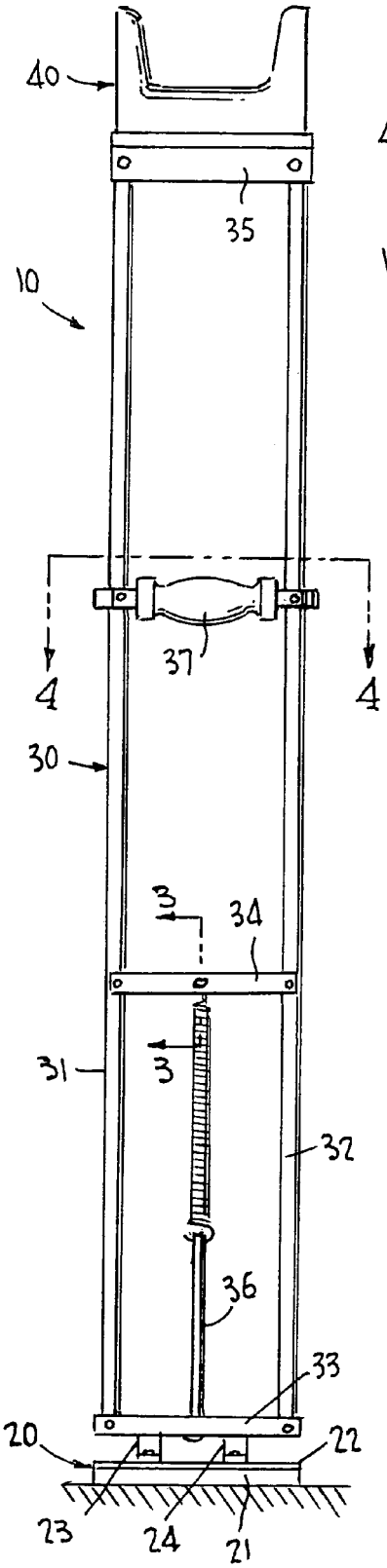
FIG. 1 shows a side elevational view of a crutch-like mobility assist device with tiltable underarm support mechanism according to a preferred embodiment of the present invention.
Figure 2:
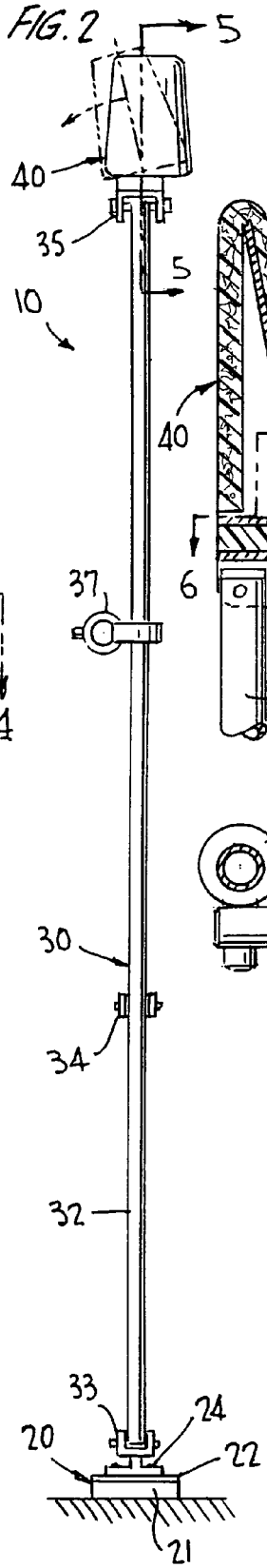
FIG. 2 is a rear elevational view thereof.

A preferred embodiment of a crutch-like mobility assist device with tiltable underarm support mechanism according to the present invention is generally labeled 10 in FIGS. 1 and 2. It includes a footer assembly 20, a vertical support assembly 30 and a tiltable underarm support assembly 40.

The footer assembly 20 includes an elongated, generally rectangular foot pad 21, an elongated footer plate 22 located on the foot pad, and two attachment blocks 23 and 24 located in longitudinally spaced fashion on the footer plate. Bolts extend through aligned holes in the base flanges of the attachment blocks and in the footer plate, and then into the foot pad, to connect these elements together. The bolts could be replaced by other attachment means such as screws, brackets, etc. The foot pad is made of a durable, non-skid material such as neoprene for reliable engagement with a ground or flooring surface during use of the mobility assist device. The attachment blocks connect to a lower connection member 33 of the vertical support assembly 30. The footer assembly can be a rotatable footer assembly as disclosed in concurrently filed application Ser. No. 11/637,928, entitled "Crutch-Like Mobility Assist Device and Rotatable Footer Assembly."

The vertical support assembly 30 includes vertical support rods 31 and 32 which are connected at their corresponding lower ends by lower connection member 33, at their corresponding upper ends by upper connection member 35, and by an intermediate connection member 34 located above the lower connection member 33 at about ⅓ the distance to the upper connection member 35. Each of these connection members has a generally U-shaped cross-section (the upper connection and intermediate members have inverted U-shaped cross-sections), and are connected near their opposite ends to the rods 31 and 32 by rivets, thus enabling rotation. The rivets could be replaced by other connection means that allow rotation, such as pins or bolts. A spring-rod device 36 is connected between the lower connection member 33 and the intermediate connection member 34 to assist with strutter-style movements of the mobility assist device during use. A hand grip 37 is connected by suitable attachment means (rivets, pins, bolts, etc.) to the rods 31 and 32 above the intermediate connection member 34, the location being determined by the arm length of the intended user of the mobility assist device (custom fit).

The tiltable underarm support mechanism 40 includes an elongated generally rectangular damper pad 41 located on the upper connection member 35 of the vertical support assembly 30, a damper assembly 42 located on the damper pad, and a saddle 60 mounted on the damper assembly.

Figure 5:
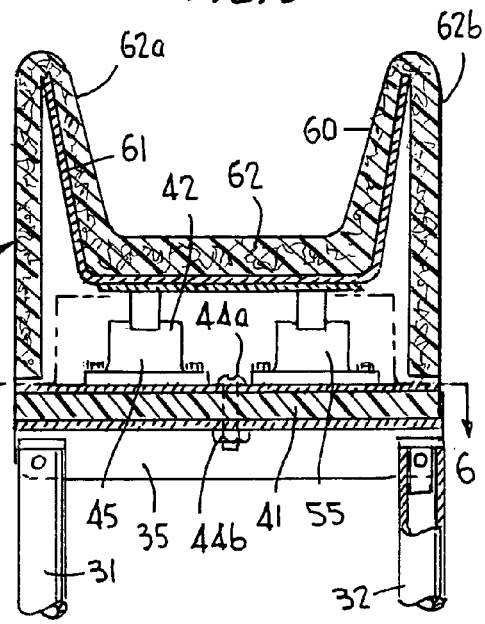
FIG. 5 is a cross-sectional view thereof as seen along line 5-5 in FIG. 2, this view showing a cross-section of the inventive tiltable underarm support mechanism.
Figure 4:
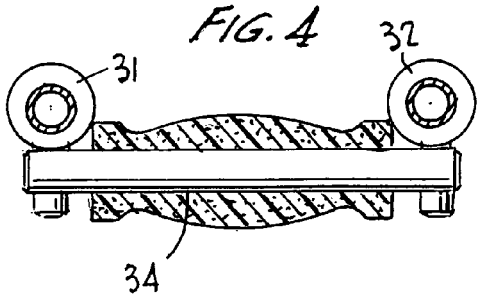
FIG. 4 is a cross-sectional view thereof as seen along line 4-4 in FIG. 1.
Figure 3:
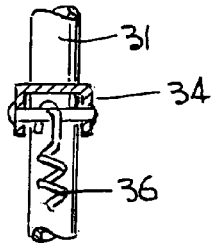
FIG. 3 is a cross-sectional view thereof as seen along line 3-3 in FIG. 1.
Figure 6:
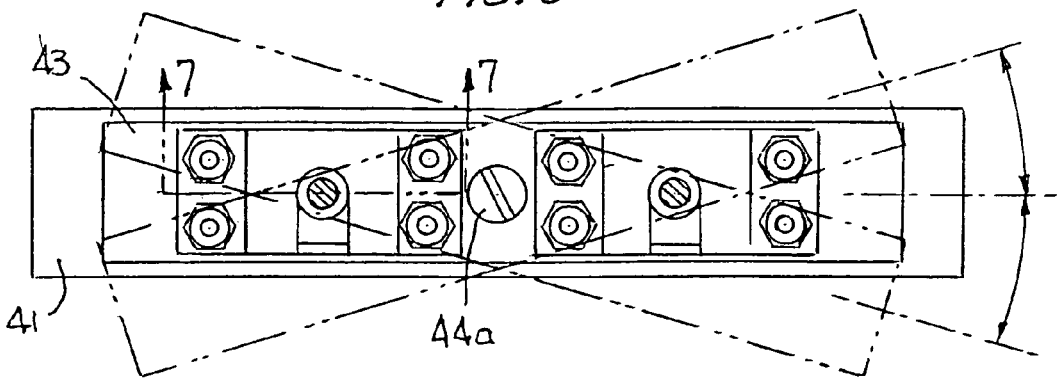
FIG. 6 is a cross-sectional view of the underarm support mechanism as seen along line 6-6 in FIG. 5.

As best seen in FIG. 5, the saddle 60 includes an elongated frame member 61 which has a generally U-shaped cross-section, and a permeable covering or cushion 62 which has a generally U-shaped center portion 62*a* and a skirt portion 62*b* that extends downwardly all the way around. The permeable covering can be made of a honeycomb material that allows moisture and air transport therethrough during use of the mobility assist device to reduce underarm chaffing. The skirt portion 62*b* extends downwardly to a point just above damper pad 41 to prevent a user's clothing from becoming caught within the mechanism.

The damper assembly 42 includes an elongated, generally rectangular base plate 43 which is located on the damper pad 41. A hole is provided in the middle of the base plate 43 and a bolt 44*a* extends through the hole and through aligned holes in the damper pad 41 and the upper connection member 35. A nut 44*b* is threadingly engaged with the threaded end of the bolt 44*a*. Loosening and tightening of the nut 44*b* enables the base plate (and the saddle thereabove) to be rotated relative to the upper connection member 35 to an angle based on the comfort and desires of the user (custom fit). Damper devices 45 and 55 are located in longitudinally spaced fashion on the base plate 43 (on opposite sides of bolt 44*b*). These damper devices are identical in construction, and so only the construction of damper device 45 will be now explained.

Figure 7:
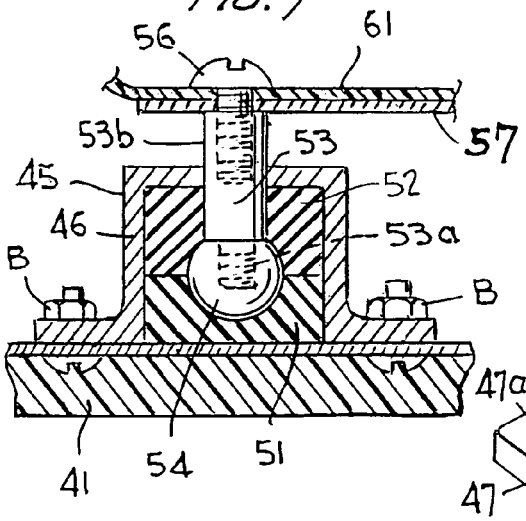
FIG. 7 is a cross-sectional view of the underarm support mechanism as seen along line 7-7 in FIG. 6.
Figure 7:
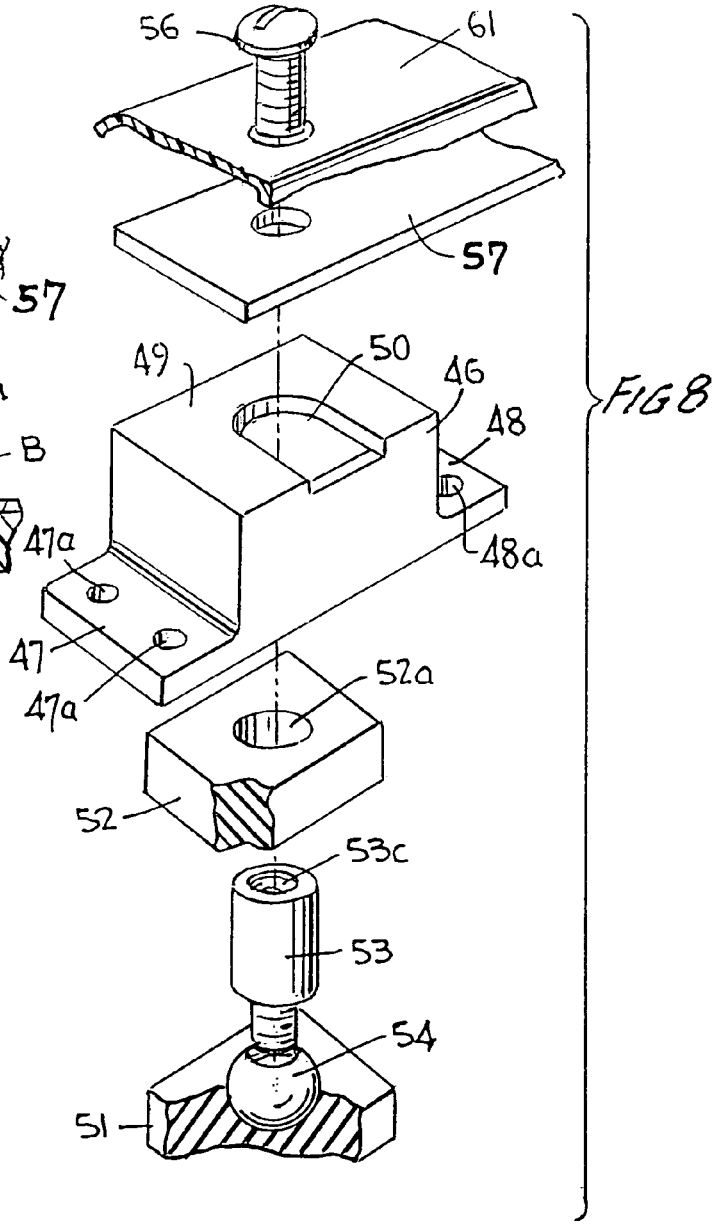

As best seen in FIGS. 7 and 8, the damper device 45 includes a damper box 46 having base flanges 47 and 48 with holes 47*a* and 48*a* therethrough and a top wall 49 providing a lateral slot 50. Bolts B extending through the holes 47*a* and 48*a* and through aligned holes in the base plate 43 fixedly position the damper box on the base plate. Lower and upper damper blocks 51 and 52 made of a compressible material such as neoprene are positioned in the damper box 46, and a support pin 53 having an externally threaded projection 53*a* at its lower end and an internally threaded bore 53*c* in its upper end 53*b* extends in tight-fit fashion through a hole 52*a* in the upper damper block 52 and above the top wall 49. A threaded ball cap 54 is attached to the projection 53*a* and is tightly squeezed in position between the lower and upper damper blocks. The support rod can move downwardly to some degree against the upward bias of the lower damper block 51, and can tilt laterally along the slot 50 against the returning bias of the upper damper block 52. One end of an elongated, generally rectangular top plate 57 is positioned over the support pin 53, as is the frame member 61 of saddle 60, and a bolt 56 extends downwardly through holes in the frame member 61 and the top plate 57 to be threadingly fixed in the bore 53*c* of the support pin 53.

When a user of the mobility assist device positions the saddle 60 in his (or her) armpit and places weight thereon, he (or she) can move the saddle so that either a forward end or a rearward end is tilted downwardly (by downward movement of one or both of the support pins 53 of the damper devices 45 or 46 within their respective damper boxes). In addition, the user can tilt the saddle sideways by lateral movement of support pins 53 in the slots 50 of their respective damper boxes. This provides great comfort to the user while using the mobility assist device.

Although a detailed description of a preferred embodiment of the inventive crutch-like mobility assist device and tiltable underarm support mechanism has been provided, modifications can be made therein and still fall within the scope of the appended claims. For example, the underarm support mechanism can employ more than two damper boxes, if desired, to increase the damping effect.

We claim:

1. A tiltable underarm support mechanism for a crutch which comprises:

an elongated base plate, a saddle located above the base plate, and a damper assembly located between the base plate and the saddle, said damper assembly comprising:

first and second longitudinally spaced damper devices connected to the base plate, each of said damper devices including a damper box having a top wall with a lateral slot, a support pin which extends from within the damper box upwardly through the slot, a biasing means within the damper box to bias the support pin upwardly within the damper box and to a vertical orientation, and a top plate which is positioned over upper ends of the support pins of the first and second damper devices and connected thereto, said saddle being connected to said top plate, said saddle being forwardly, rearwardly and laterally tiltable due to movement of said support pins relative to said damper boxes.

2. A tiltable underarm support mechanism according to claim 1, wherein said biasing means comprises a block of compressible material.

3. A tiltable underarm support mechanism according to claim 2, wherein said biasing means comprises a lower and an upper block of compressible material.

4. The tiltable underarm support mechanism according to claim 3, wherein said support pin extends through a hole in said upper block.

5. The tiltable underarm support mechanism as defined in claim 3, wherein said support pin includes a lower end, a ball cap attached to said lower end, and an internally-threaded bore at an upper end thereof.

6. The tiltable underarm support mechanism according to claim 1, including a damper pad beneath said base plate.

7. The tiltable underarm support mechanism according to claim 6, wherein said base plate includes a hole in the center thereof, and including a bolt which extends through said hole and an aligned hole in said damper pad to enable said base plate to rotate relative to said damper pad.

8. The tiltable underarm support mechanism according to claim 7, including a nut connected to said bolt to fixedly position said base plate relative to said damper pad.

9. The tiltable underarm support mechanism as defined in claim 1, wherein said saddle comprises an elongated frame having a generally U-shaped cross-section, and an air permeable covering material which includes a skirt that extends downwardly towards said base plate.

10. A crutch-like mobility assist device which comprises:

a vertical support assembly having two support rods and lower and upper connection members, a footer assembly connected to the lower connection member, and a tiltable underarm support mechanism connected to the upper connection member, said tiltable underarm support mechanism comprising:

an elongate base plate, a saddle located above the base plate, and a damper assembly located between said base plate and said saddle, said damper assembly comprising:

first and second longitudinally spaced damper devices connected to the base plate, each of said damper devices including a damper box having a top wall with a lateral slot, a support pin which extends from within the damper box upwardly through the slot, a biasing means within the damper box to bias the support pin upwardly within the damper box and to a vertical orientation, and a top plate which is positioned over upper ends of the support pins of the first and second damper devices and connected thereto, said saddle being connected to said top plate, said saddle being forwardly, rearwardly and laterally tiltable due to movement of said support pins relative to said damper boxes.

11. The crutch-like mobility assist device according to claim 10, wherein said biasing means comprises a block of compressible material.

12. The crutch-like mobility assist device according to claim 11, wherein said biasing means comprises a lower and an upper block of compressible material.

13. The crutch-like mobility assist device according to claim 12, wherein said support pin extends through a hole in said upper block of compressible material.

14. The crutch-like mobility assist device according to claim 12, wherein each support pin includes a lower end, a ball cap attached to said lower end, and an internally-threaded bore at an upper end thereof.

15. The crutch-like mobility assist device according to claim 10, including a damper pad beneath said base plate.

16. The crutch-like mobility assist device according to claim 15, wherein said base plate includes a hole in the center thereof, and including an attachment means which extends through said hole and an aligned hole in said damper pad to enable said base plate to rotate relative to said damper pad.

17. The crutch-like mobility assist device according to claim 16, wherein said saddle comprises an elongated frame having a generally U-shaped cross-section, and an air-permeable material positioned over said elongated frame.

* * * * *